United States Patent [19]

Roda

[11] Patent Number: 4,630,842

[45] Date of Patent: Dec. 23, 1986

[54] METHOD AND APPARATUS FOR CARRYING SNOW SKIS

[76] Inventor: Gary E. Roda, 367 Rugby Ave., Berkeley, Calif. 94708

[21] Appl. No.: 761,693

[22] Filed: Aug. 2, 1985

[51] Int. Cl.[4] ..... A63C 11/02

[52] U.S. Cl. ..... 280/814; 224/917; 294/147

[58] Field of Search ..... 294/143, 147, 15; 224/185, 270, 917; 280/814, 816, 809

[56] References Cited

U.S. PATENT DOCUMENTS

| | | | |
|---|---|---|---|
| 2,340,868 | 2/1944 | Dye | 280/814 X |
| 3,377,095 | 4/1968 | Allen | 294/15 |
| 3,549,065 | 12/1970 | Schubert | 294/143 |
| 3,714,803 | 2/1973 | Chenenko | 280/814 |
| 3,727,934 | 4/1973 | Averbook et al. | 280/814 |

FOREIGN PATENT DOCUMENTS

| | | | |
|---|---|---|---|
| 2214104 | 9/1973 | Fed. Rep. of Germany | 224/917 |
| 226705 | 4/1943 | Switzerland | 280/814 |

*Primary Examiner*—John J. Love
*Assistant Examiner*—Michael Mar
*Attorney, Agent, or Firm*—H. Michael Brucker

[57] ABSTRACT

A method and apparatus for carrying snow skis wherein ski tip receiver is permanently secured at the upper surface of a snow ski defining a cylindrical space sized to receive a ski pole tip and oriented to permanently align the cylindrical space perpendicular to the length of the ski such that when a ski pole tip is inserted into the cylindrical space, the ski pole will be disposed perpendicular to the length of the ski. The accessory permits skis to be carried by the method of inserting a ski pole tip in each ski tip receiver, hoisting the ski poles on a skier's shoulder to align the skis vertically along, and spaced from, the back of the skier, and secure and steady skis by gripping the ski poles with a hand.

5 Claims, 6 Drawing Figures

METHOD AND APPARATUS FOR CARRYING SNOW SKIS

BACKGROUND OF THE INVENTION

The present invention relates to methods and apparatus for carrying snow skis using ski poles.

Because of their length and weight, snow skis when not being worn by a skier are cumbersome items to carry at best and when being transported in and about a ski area potentially dangerous instrumentalities.

By far the most common method for carrying skis is to secure the skis together, (running surface to running surface) and hoist the skis onto the skier's shoulder where they are secured and balanced by the skier's hand. The other hand is normally used to carry ski poles and any other equipment then being transported. While this method is the most popular, it is also very dangerous. The shouldered skis extend outwardly behind and partially out of sight of the skier while the skier is likely walking on a snow or ice covered surface, wearing boots which are not designed for walking and while generally unbalanced by the weight of the skis and the lack of use of the pole-carrying hand. If the skier slips or simply turns, anyone within the radius of the ski tips will be likely hit, generally above the neck.

A number of devices are known and marketed which attach to a pair of skis and provide a handle which permit the skis to be carried as one would carry a suitcase. These devices often include securing means for the ski poles as well, or use of the poles as part of the handle and thus permit skis and poles to be carried in one hand. These devices have not found widespread use, however, because they must be removed from the skis and stowed separately from the skis while the skis are in use. This requires either that the device be carried in a backpack or similar carrying device on the skier or be put in a locker or some other secure place. Because of this inconvenience and proliferation of gear, the vast majority of skiers have not embraced these ski carrying devices but instead persist in the more convenient but at the same time more dangerous method of carrying their skis over their shoulder. Both the shoulder carry method and the devices which provide a suitcase-like carrying handle for skis have the further disadvantage of placing the skis in a generally horizontal position perpendicular to the skier. The carrying devices have the advantage of locating the skis at knee level rather than head level, but they still place the ski ends some distance from the skier and in position to easily strike other skiers.

Another method that some skiers use to avoid the disadvantages cited above, is to slide a ski pole under the toe binding of each ski (while the skis are secured running surface to running surface) and hoist the poles onto a shoulder thereby disposing the skis generally vertical along the skier's back. This method, however, works only with those models of toe bindings having enough space to receive the shank of a ski pole and even for those bindings there are two serious drawbacks. First, the skis tend to ride down the poles and rest against and possibly soil the skier's garments, and second, the bindings are subject to forces that can cause damage to them or change their adjustment. Because of these drawbacks, this carrying method is rarely seen in practice.

Since few skiers have the strength to simply carry their skis in one hand maintaining the skis in a generally vertical direction (the safest way to carry skis), the shoulder carry is ultimately resorted to giving rise to all of the dangers mentioned above. It is an object of the present invention to provide an accessory for a snow ski which is permanently attached to the ski and which makes it possible to employ a carry method by which the skis are conveniently carried in a generally vertical position with both the skis and ski poles in one hand wherein the skis cannot slide down the poles and wherein no potentially damaging forces are applied to the bindings.

BRIEF DESCRIPTION OF THE INVENTION

The present invention teaches means and methods by which snow skis secured together (running surface to running surface) are secured to the tips of a pair of ski poles in such a manner that when the ski poles are placed on the skiers shoulder, the skis are disposed in a generally vertical position parallel to and spaced from the skier's back. The invention contemplates attaching to each of a pair of snow skis a ski pole tip receiver means that defines a cylindrical space sized to receive ski pole tips and oriented such that the axis of the cylindrical space is permanently fixed generally perpendicular to the longitudinal axis of the skis so that the ski poles will be generally perpendicular to the length of the skis when the pole tips are inserted in the receiver means. Since the receiver means are small and permanently secured to the skis, they do not comprise additional "gear" which must be accounted for separate from the skis themselves. As will be described more fully below, the ski pole tip receiver of the present invention may be an integral part of the ski itself or of a portion of a ski binding as well as a separate attachable part so long as it provides a generally cylindrical space for receiving the tips of a ski pole oriented as described above. The method of carrying skis of the present invention comprises the steps of securing the tip ends of a pair of ski poles to the upper surfaces of a pair of ski at a generally right angle thereto, placing the shanks of the poles onto one shoulder so as to dispose the skis generally parallel to the skier's back and spaced therefrom, and secure and steady the skis in place by the skier gripping the ski poles with a hand.

DETAILED DESCRIPTION OF THE INVENTION

Figure 1:
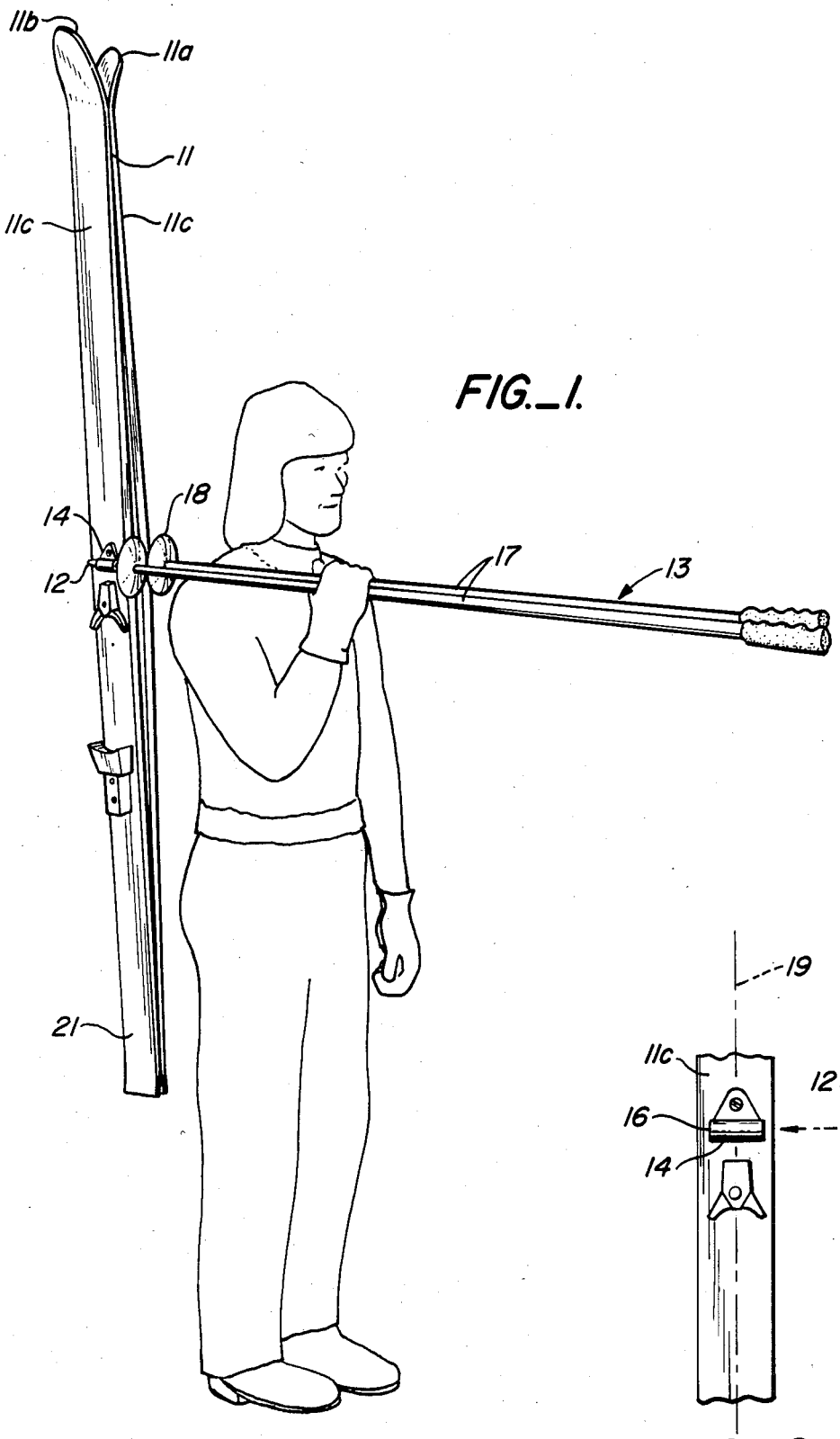
FIG. 1 is an isometric view showing a skier carrying a pair of snow skis according to the present invention.

Referring to FIG. 1, a skier is illustrated carrying a pair of snow skis 11 according to the method of the present invention. The skis which have been secured together running surface 11*a* to running surface 11*b* and are disposed generally vertical and parallel to and spaced from the skier's back by means of the tips 12 (only one of which is shown) of ski poles 13 being inserted into ski poles tip receiver means 14 (only one of which is shown) of the present invention attached to the upper surfaces 11*c* of the skis 11 and the pole shafts 17 disposed on the skier's shoulder. The skis are secured and steadied by gripping the pole shanks with a hand.

Figure 2:
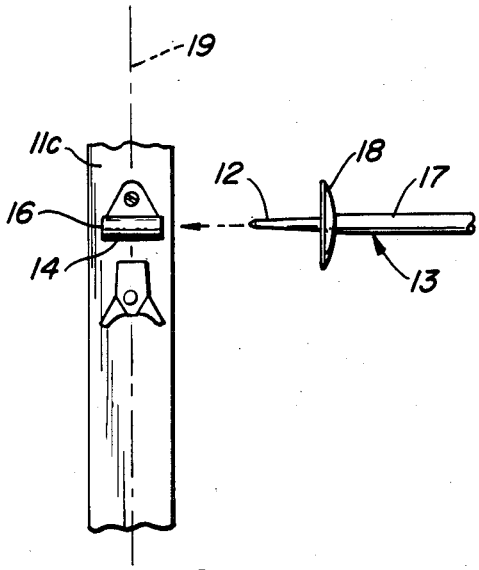
FIG. 2 is a plan view of a portion of a ski including the present invention together with a portion of a ski pole showing how the tip of the ski pole interacts with the present invention.
Figure 3:
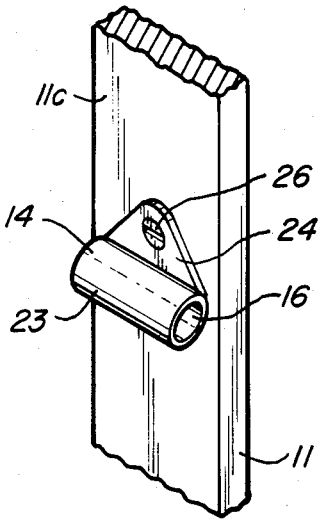
FIG. 3 is an isometric view of one embodiment of the present invention shown in connection with a portion of a ski to which it is attached.

Referring to FIGS. 2 and 3, the ski tip receiver means 14 defines a generally cylindrical space 16 sized to receive the tip 12 of a ski pole 13. While the cylindrical space 16 is shown having a circular cross-section, certain manufacturing methods may make a non-circular corss-section less expensive to make. The invention does not require that the cylindrical space 16 be circular in cross-section. One of the important features of the present invention is that the receiver means 14 is designed and sized to receive the tip 12 of the ski pole 13 and not the shaft 17. Since the tip 12 and shaft 17 are separated by a basket 18, the basket serves as a stop. The tendency when carrying skis in the manner illustrated in FIG. 1 is to pull down on the shafts 17. But for the baskets 18, the skis would tend to ride down the poles onto the skier.

The cylindrical space 16 (which need not be circular in cross-section) is oriented to be generally perpendicular to the longitudinal axis 19 of the ski so that when the pole tip 12 is inserted into the space 16, the ski poles 13 will remain under load conditions generally perpendicular to the longitudinal axis 19 of the skis.

The combination of rigidly maintaining space 16 perpendicular to the longitudinal axis of the skis and sizing space 16 to receive the tip of a ski pole permits the skis to be carried by the method of the invention and thereby maintained vertical, generally parallel to, and spaced from the back of a skier, as shown in FIG. 1.

If the ski pole tip receiver means 14 is not rigidly attached to the ski but rather rotatable or otherwise movable, the orientation of the space 16 and inserted tips, relative to the length of the ski, will be subject to moving away from perpendicular under load conditions resulting in the tail portions 21 of the skis tending to rotate into the lower body portion of the skier with the likely result of dislodging the skis off of the ski poles.

Ski tip receiver means 14 comprises a rigid cylindrical tube 23 defining cylindrical space 16 and integrally attach to a base plate attachment means 24 which is rigidly secured to the upper surface 11*c* of the ski as by a screw 26. The plate 24 can also be attached by epoxy or other adhesive with screw 26 or alone.

Figure 4:
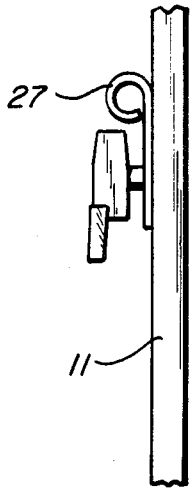
FIG. 4 is a side elevation view of an alternative embodiment of the present invention shown together with a portion of a ski.

Referring to FIG. 4, a toe piece 27 is attached to ski 11 as part of a boot binding. Cylindrical space 16 is formed directly in the binding toe piece for receiving a ski pole tip.

Figure 5:
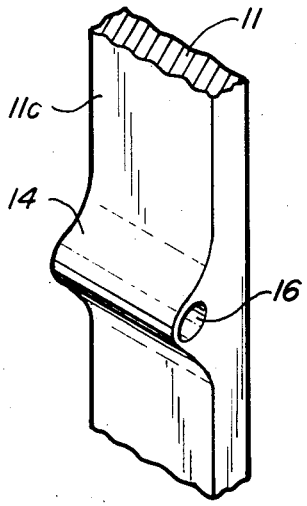
FIG. 5 is an isometric view of a portion of a ski in which the present invention is formed as an integral part.

Referring to FIG. 5 the ski tip receiver means 14 defining a cylindrical space 16 disposed perpendicular to the longitudinal axis of the ski 11 is formed in the upper surface 11*c* of the ski as part of the original equipment.

Figure 6:
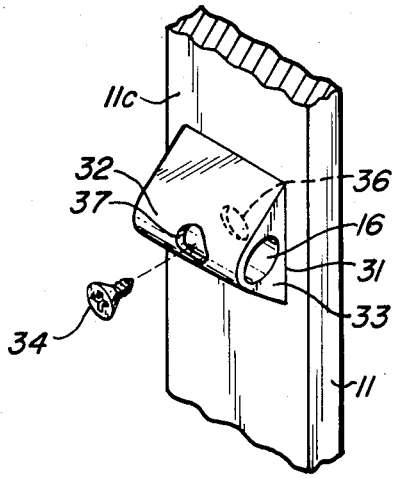
FIG. 6 is an isometric view with portions broken away of another embodiment of the invention shown in connection with a portion of a ski.

Referring to FIG. 6, another embodiment of the invention comprises a generally prismatic-shaped ski tip receiver means 14 having a base 31 and apex 32 and a pair of opposing generally triangular end members 33. The prismatic-shaped tip receiver defines the generally cylindrical space 16 which extends through the end members 33. This embodiment of the invention is secured to the upper surface 11*c* of the ski 11 by a screw 34 which attaches the base 31 to the upper surface 11*c* of the ski through a hole 36. Access to the base screw hole 36 is an aligned hole 37 in the apex 32 of the prismatic ski tip receiver means 14. This embodiment of the invention provides an attachable ski pole tip receiver means which approaches the simplicity and almost integral appearance of the original equipment embodiment of FIG. 6. At the same time, the apex 32 can be used to dislodge snow from a skier's boot bottom prior to entry into the ski bindings (not shown).

According to the present invention, skis are carried using the following method. The skis are secured together running surface to running surface, ski pole tip receiver means are provided on the upper surface of each ski for receiving a ski pole tip and maintaining the ski pole generally perpendicular to the length of the skis, inserting a ski pole tip into each receiver means, hoisting the ski poles onto a shoulder so as to locate the skis generally parallel to and spaced from the skier's back and securing the skis in place by gripping the poles with one hand.

Although all of the drawings illustrate the ski tip receiver means as being located at or forward of the ski binding toe piece, the invention is not so limited as location of the tip receiver means elsewhere, such as aft of the heal portion of the ski binding results in the same advantages and permits the same carry method to be performed.

Since many modifications, changes and alterations may be contemplated in the teachings of the present invention by one skilled in the art, it is intended that the scope of the present invention only be limited by the following claims.

What is claimed is:

1. In combination with a snow ski having a top surface and a longitudinal axis, and a ski pole having a generally cylindrical tip portion, a ski carrier accessory comprising:

a ski pole tip receiver means rigidly and non-rotatably secured to the top surface of the ski, said means defining a generally cylindrical space sized to receive and retain the cylindrical ski pole tip potion in close co-axial relationship wherein the axis of the cylindrical space is generally perpendicular to the longitudinal axis of the ski and generally parallel to the top surface of the ski whereby when the ski pole tip portion is inserted in the generally cylindrical space of the receiver means affixed to the top surface of the ski, the ski pole is effectively secured to the ski at a right angle to the longitudinal axis of the ski which orients the ski generally vertically along a skier's back when the ski pole is supported on the skier's shoulder.

2. The invention of claim 1 wherein the receiver means is an integral part of the ski top surface.

3. The invention of claim 1 wherein said receiver means is an attachable member secured to the top surface of the ski.

4. The invention of claim 1 wherein the receiver means is an integral part of a boot binding attached to the ski.

5. A method for a skier to carry a pair of snow skis having running surfaces and obverse upper surfaces, comprising the steps of:

securing the skis together running surface to running surface.

providing each ski with ski tip receiver means attached at the ski's upper surface wherein said means defines cylindrical space having its axis oriented and permanently secured at a generally right angle to the length of the ski;

placing a ski pole tip in each ski tip receiver means so that the poles are generally parallel and adjacent;

hoisting the ski poles onto the shoulder of the skier;

locating the skis generally vertically along and spaced from the skier's back; and securing and steadying the skis by gripping the poles with the skier's hand.

* * * * *